US005586542A

United States Patent [19]

Taruya et al.

[11] Patent Number: 5,586,542

[45] Date of Patent: Dec. 24, 1996

[54] IGNITION APPARATUS FOR INTERNAL COMBUSTION ENGINE

[75] Inventors: Masaaki Taruya; Mitsuru Koiwa, both of Tokyo, Japan

[73] Assignee: Mitsubishi Denki Kabushiki Kaisha, Tokyo, Japan

[21] Appl. No.: 569,987

[22] Filed: Dec. 8, 1995

[30] Foreign Application Priority Data

Mar. 31, 1995 [JP] Japan ..... 7-076159

[51] Int. Cl.[6] ..... F02P 3/04; F02P 11/00

[52] U.S. Cl. ..... 123/609; 123/645

[58] Field of Search ..... 123/609, 610, 123/611, 644, 645

[56] References Cited

U.S. PATENT DOCUMENTS

| | | | |
|---|---|---|---|
| 4,290,406 | 9/1981 | Iyoda et al. | 123/645 |
| 5,392,754 | 2/1995 | Hopper et al. | 123/609 |

FOREIGN PATENT DOCUMENTS

| | | |
|---|---|---|
| 4-31664 | 2/1992 | Japan . |
| 5-164031 | 6/1993 | Japan . |
| 5-340330 | 12/1993 | Japan . |

*Primary Examiner*—Tony M. Argenbright
*Attorney, Agent, or Firm*—Sughrue, Mion, Zinn, Macpeak & Seas

[57] ABSTRACT

An ignition apparatus for internal combustion engine includes an ignition power unit 1A having an ignition coil 13 and a power transistor 14 for supplying and shutting off a primary current i1 to the ignition coil; and a control circuit 2A for determining ignition timing of the internal combustion engine and a period for supply of the primary current in accordance with driving conditions D of the internal combustion engine so that it generates an ignition signal Ga in the form of a pulse to the power transistor. The primary current is supplied and shut off by the power transistor in accordance with the ignition signal to produce a high-tension secondary voltage V2 from the ignition coil. The control circuit includes an oscillation circuit 23 starting operation from a point when the ignition signal rises and operating for a predetermined period shorter than a pulse width of the ignition signal, the waveform of the ignition signal thereby being made to rise gradually. With this arrangement, there is obtained an ignition apparatus for internal combustion engine by which faulty operation can be prevented at a time when the ignition signal rises and the size and cost of the ignition apparatus can be reduced without using a high-tension diode.

2 Claims, 3 Drawing Sheets

FIG. 1
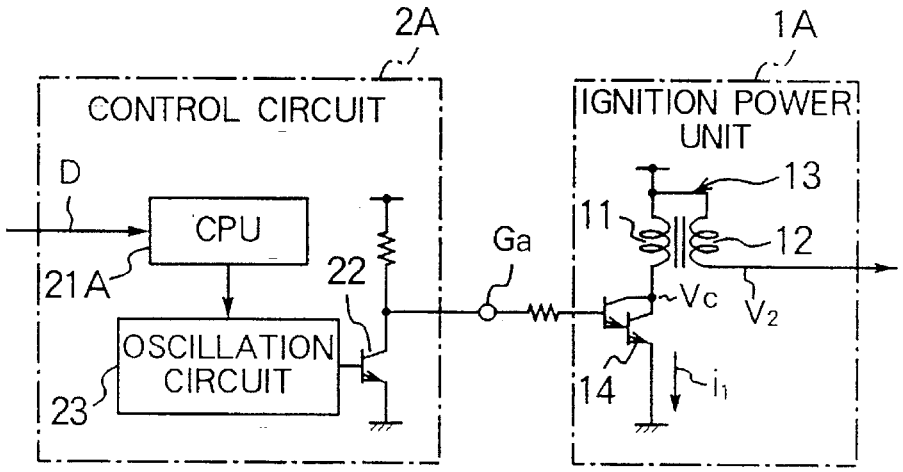
FIG. 2A
FIG. 2B
FIG. 2C
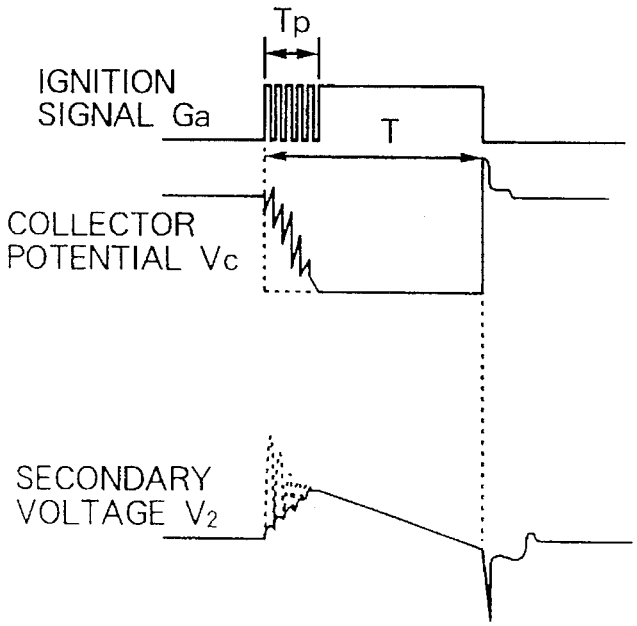

PRIOR ART
FIG. 6
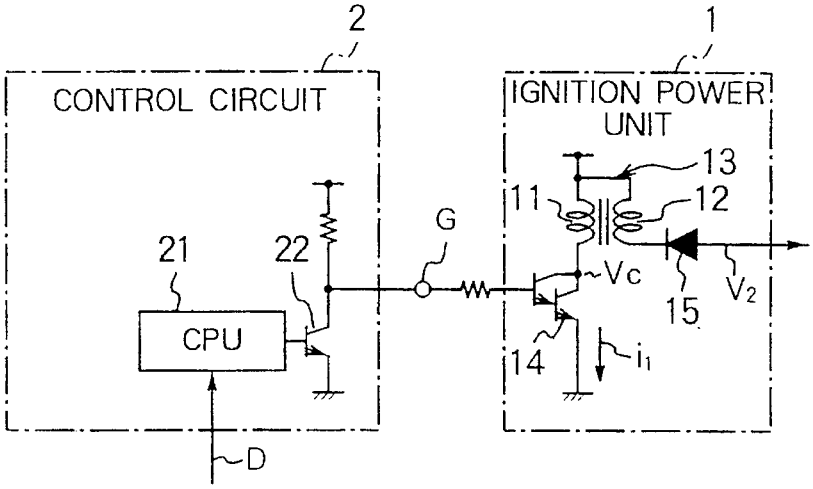
PRIOR ART
FIG. 7A
FIG. 7B
FIG. 7C
FIG. 7D
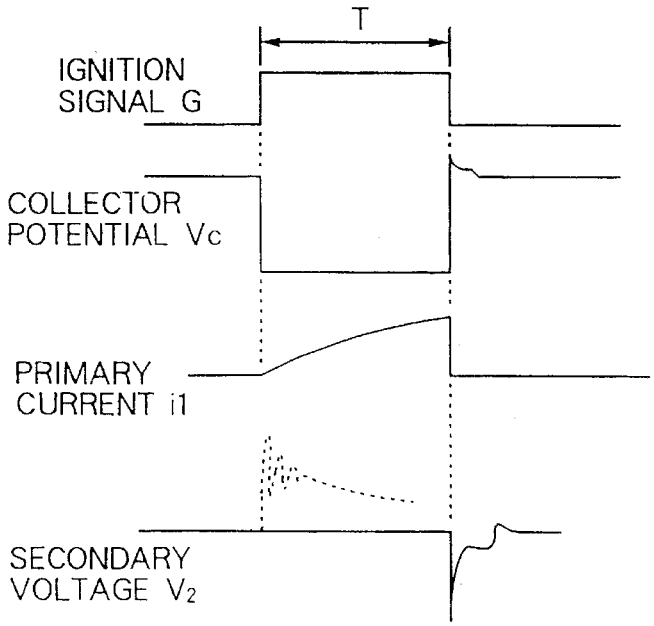

IGNITION APPARATUS FOR INTERNAL COMBUSTION ENGINE

BACKGROUND OF THE INVENTION

1. Field of the Invention

The present invention relates to an ignition apparatus for internal combustion engine employing an electronic distribution system for supplying and shutting off a primary current to an ignition coil using a power transistor, and more specifically, to an ignition apparatus for internal combustion engine effectively preventing faulty operation caused when the supply of the primary current is started (when an ignition signal rises) without using a high-tension diode.

2. Description of the Related Art

Conventionally, an ignition apparatus for internal combustion engine employing an electronic distribution system having an ignition coil independently provided with each ignition plug controls an amount of fuel to be injected to each cylinder and ignition timing by electronic calculation using a microcomputer.

Although a primary current is supplied and shut off to the ignition coil by turning on and off a power transistor by an ignition signal at the time, there is a possibility that faulty operation such as early firing and the like may be caused by a high-tension secondary voltage induced when the ignition signal rises.

The conventional ignition apparatus for internal combustion engine has a high-tension diode inserted to the secondary side of an ignition coil to prevent the above faulty operation and prohibits the output of a high-tension secondary voltage when the ignition signal rises.

The conventional ignition apparatus for internal combustion engine will be described below with reference to FIG. 6 and FIG. 7. FIG. 6 is a circuit arrangement diagram showing the conventional ignition apparatus for internal combustion engine and FIG. 7 shows a waveform diagram explaining operation of the conventional apparatus shown in FIG. 6.

In FIG. 6, an ignition power unit 1 includes an ignition coil 13 composed of a primary coil 11 and a secondary coil 12 and a power transistor 14 for supplying and shutting off a primary current i1 to the primary coil 11 and applies a high-tension secondary voltage V2 which is output from the secondary coil 12 to the ignition plug of each cylinder (not shown).

A high-tension diode 15 for preventing faulty operation is inserted to the output terminal of the secondary coil 12 so that a positive polarity voltage to be superposed with the secondary voltage V2 can be removed. The primary coil 11 and secondary coil 12 in the ignition coil 13 has a common power distribution terminal connected to a battery power unit.

The power transistor 14 is composed of an emitter-grounded NPN transistor and has a collector connected to the primary coil 11.

A control circuit 2 includes a CPU 21 composed of a microcomputer and an output transistor 22 for amplifying a control signal from the CPU 21. The CPU 21 controls fuel injection to each cylinder of an internal combustion engine in accordance with operating state signals D from various sensors (not shown) as well as calculates ignition timing (corresponding to timing at which the primary current i1 is shut off) and a period for supply of the primary current i1 (corresponding to the pulse width T of an ignition signal G) and outputs the ignition signal G to the power transistor 14 through the output transistor 22.

The output transistor 22 is composed of an emitter-grounded NPN transistor having a collector connected to the battery power unit.

The ignition signal G is applied to the base of the power transistor 14 to supply and shut off the primary current i1 and causes the ignition coil 13 to produce a high-tension secondary voltage V2.

Note, the operating state signals D obtained from the various sensors include, for example, an engine r.p.m., amount of intake air, cooling water temperature, intake manifold pressure, degree of throttle opening, amount of accelerator depression and the like.

FIG. 7 shows waveform diagrams of various signals in FIG. 6 and shows the changes in time of the collector potential Vc (FIG. 7B) of the power transistor 14, primary current i1 (FIG. 7C) and secondary voltage V2 (FIG. 7D) each produced by the application of the ignition signal G (FIG. 7A).

Next, operation of the conventional ignition apparatus for internal combustion engine shown in FIG. 6 will be described with reference to FIG. 7.

First, the CPU 21 in the control circuit 2 injects fuel to each cylinder of the internal combustion engine at optimum timing in accordance with the operating state signals D as well as outputs the ignition signal G to optimize a period for supply of the primary current i1 and ignition timing (shut-off timing).

The power transistor 14 in the ignition power unit 1 is turned on in response to the ignition signal G at an H level and starts to supply the primary current i1 to the primary coil 11.

The ignition signal G is changed to an L level at optimum timing after the primary current i1 reaches a target current value and turns off the power transistor 14 to shut off the primary current i1. With this operation, the high-tension secondary voltage V2 is induced to the secondary coil 12 so that discharge spark is produced to each ignition plug to cause ignition.

When the collector potential Vc of the power transistor 14 steeply drops when the ignition signal G rises, however, an induction voltage is produced to the ignition coil 13 so that a relatively high-tension noise signal is superposed with the secondary voltage V2 as shown by a dotted line of FIG. 7.

If discharge spark is produced by the noise signal to the ignition plug of a cylinder in an intake process or compression process, ignition or firing is caused at undesired early timing.

To cope with this problem, the high-tension diode 15 is inserted to the output terminal of the ignition coil to output the secondary voltage V2 from which a superposed noise signal of positive polarity is removed.

With this arrangement, the effect of the secondary voltage V2 which is caused when the supply of the primary current i1 is started can be restrained to prevent faulty operation.

However, the insertion of the high-tension diode 15 results in the increase of the number of parts and circuit arrangements as well as the increase of the size and weight of the ignition apparatus because of the necessity for securing a parts mounting space and insulation space and further the increase of a job cost necessary to the assembly of the ignition coil 13, the connection to the secondary coil 12 and the like.

Further, since the high-tension diode 15 is not only applied with the high-tension secondary voltage V2 but also accommodated in the vicinity of the ignition coil 13 which generates high temperature, the high tension-diode 15 must have sufficient reliability to withstand adverse environment in which it is used, so that the cost of the diode is increased, by which the cost of the ignition apparatus as a whole is also increased.

As described above, since the conventional ignition apparatus for internal combustion engine includes the high-tension diode 15 inserted to the output terminal of the ignition coil 13 which produces the secondary voltage V2 to prevent faulty operation caused when the ignition signal G rises, there is a problem that the number of parts is increased to thereby increase the size of the ignition apparatus and the cost of the apparatus.

An object of the present invention made to solve the above problem is to provide an ignition apparatus for internal combustion engine capable of restraining faulty operation caused when an ignition signal rises without using a high-tension diode and reducing the size and cost of the apparatus.

SUMMARY OF THE INVENTION

An ignition apparatus for internal combustion engine according to the present invention comprises: an ignition power unit having an ignition coil and a power transistor for supplying and shutting off a primary current to the ignition coil; and a control circuit for determining an ignition timing of the internal combustion engine and a period for supply of the primary current in accordance with driving conditions of the internal combustion engine so that it generates an ignition signal in the form of a pulse to the power transistor, in which the primary current is supplied and shut off in accordance with the ignition signal and a high-tension secondary voltage is produced from the ignition coil; wherein the control circuit includes an oscillation circuit starting operation from a point when the ignition signal rises and operating for a predetermined period shorter than a pulse width of the ignition signal, the waveform of the ignition signal thereby being made to substantially rise gradually.

According to the above structure, when the ignition signal rises, the ignition signal is oscillated at a high frequency for a predetermined period to cause the power transistor to be substantially gradually turned on to restrain the secondary voltage produced when the supply of the primary current is started.

Furthermore, an ignition apparatus for an internal combustion engine according to the present invention, wherein the control circuit includes a PWM circuit which operates in synchronism with the oscillation circuit, whereby the oscillation pulse widths of the rising waveform of the ignition signal are gradually increased.

According to the above structure, the high frequency oscillation pulse widths of the ignition signal are gradually increased by subjecting oscillation pulses to PWM control when the ignition signal rises to further smooth the gradual property of the rising ignition signal.

BRIEF DESCRIPTION OF THE DRAWINGS

FIG. 1 is a circuit arrangement diagram showing an embodiment 1 of the present invention;

FIGS. 2A–2C are waveform diagrams explaining operation of the embodiment 1 of the present invention;

FIG. 6 is a circuit arrangement diagram showing a conventional ignition apparatus for internal combustion engine; and FIGS. 7A–7D are waveform diagrams explaining operation of the conventional ignition apparatus for internal combustion engine.

DESCRIPTION OF PREFERRED EMBODIMENTS

Embodiment 1

Figure 3:
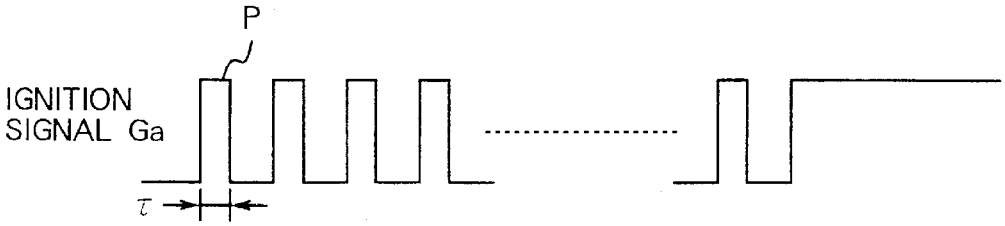
FIG. 3 is a waveform diagram showing the enlarged rising portion of an ignition signal of FIG. 2.

A first embodiment of the present invention will be described below with reference to the drawings.

FIG. 1 is a circuit arrangement diagram showing the first embodiment of the present invention. In FIG. 1, an ignition power unit 1A includes an ignition coil 13 for outputting a secondary voltage Va and a power transistor 14 for supplying and shutting off a primary current i1 and is arranged in the same way as the aforesaid ignition power unit 1 except that the high-tension diode 15 (refer to FIG. 6) is removed therefrom.

A control circuit 2A is arranged in the same way as the aforesaid control circuit 2 except that an oscillation circuit 23 is additionally inserted between a CPU 21A and the base of an output transistor 22.

The oscillation circuit 23 operates for a predetermined short period Tp which is shorter than the pulse width T of an ignition signal Ga from a time when the ignition signal Ga rises under the control of the CPU 21A to thereby make the rising waveform of the ignition signal Ga gradual.

FIG. 2 shows waveform diagrams explaining operation of the first embodiment of the present invention and shows the changes in time of a collector potential Vc (FIG. 2B) and the secondary voltage V2 (FIG. 2C) to the ignition signal Ga (FIG. 2A).

FIG. 3 is a waveform diagram showing the enlarged rising portion of the ignition signal Ga of FIG. 2 and the rising portion of the ignition signal Ga is composed of a plurality of high frequency oscillation pulses P.

Next, the operation of the first embodiment of the present invention will be described with reference to FIG. 2 and FIG. 3.

Likewise the above-mentioned, the CPU 21A in the control circuit 2A injects fuel to each cylinder at optimum timing as well as outputs the ignition signal Ga for determining the supply and shut-off of the primary current il in accordance with operating state signals D.

The power transistor 14 in the ignition power unit 1A starts to supply the primary current il in response to the ignition signal Ga and shuts off the primary current il at predetermined ignition timing.

At the time, the oscillation circuit 23 in the CPU 21A causes the ignition signal Ga to oscillate at a high frequency for a predetermined period Tp (for example, a period one third the pulse width T of the ignition signal Ga) at a time when the ignition signal Ga rises. In this case, it is assumed that the frequency and pulse width τ of high frequency oscillation pulses P are set constant as shown in FIG. 3.

Consequently, the collector potential Vc drops not steeply as shown by a dotted line of FIG. 2 (when high frequency oscillation is not made) but stepwise as shown by a solid line.

As a result, a high-tension noise signal (refer to a dotted line) is not superposed with the secondary voltage V2 and only a stepwise low-tension noise is superposed therewith as shown by a solid line.

As described above, the rising waveform of the ignition signal Ga is made substantially gradual by only the provision of the oscillation circuit 23 disposed in the control circuit 2A without inserting the high-tension diode 15 (refer to FIG. 6) to the output terminal of the ignition coil 13 so that the a high-tension noise signal can be restrained from being superposed with the secondary voltage V2.

Therefore, faulty operation can be securely prevented with sufficient reliability by a simple circuit arrangement and operating performance without increasing cost.

Embodiment 2

Note, although the high frequency oscillation pulses P oscillated by the oscillation circuit 23 are set constant in the above first embodiment, the gradual property of the rising ignition sinal may be more smoothed by the addition of a PWM (pulse width modulation) circuit.

A second embodiment of the present invention having the PWM circuit added to a control circuit will be described below.

Figure 4:
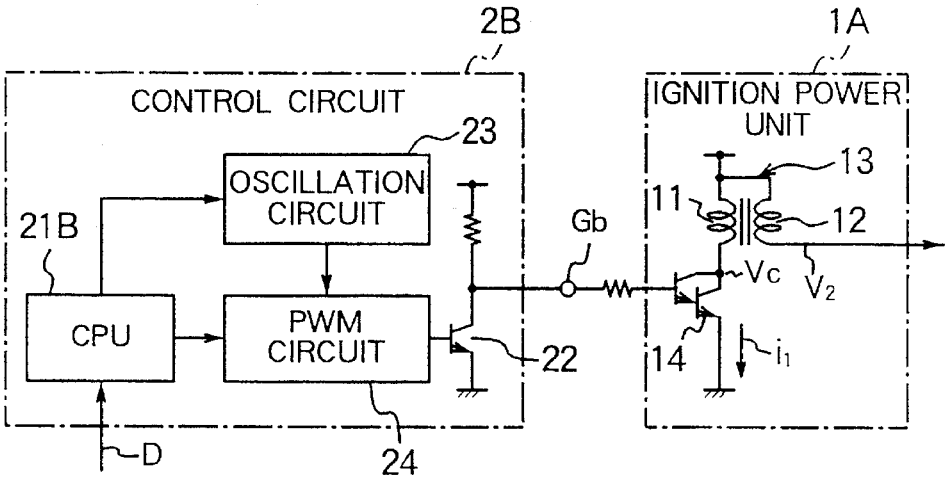
FIG. 4 is a circuit arrangement diagram showing an embodiment 2 of the present invention.

FIG. 4 is a circuit arrangement diagram showing the second embodiment of the present invention, wherein an ignition power unit 1A is arranged in the same way as that shown in FIG. 1. Further, the control circuit 2B is arranged in the same way as the control circuit 2A of FIG. 1 except that the PWM circuit 24 is interposed between the output of an oscillation circuit 23 and an output transistor 22.

The PWM circuit 24 operates in synchronism with the oscillation circuit 23 under the control of a CPU 21B and gradually increases the respective pulse widths τ1, τ2, . . . τn of the oscillation pulses P1, P2, . . . , Pn of the rising waveform of an ignition signal Gb.

Figure 5:
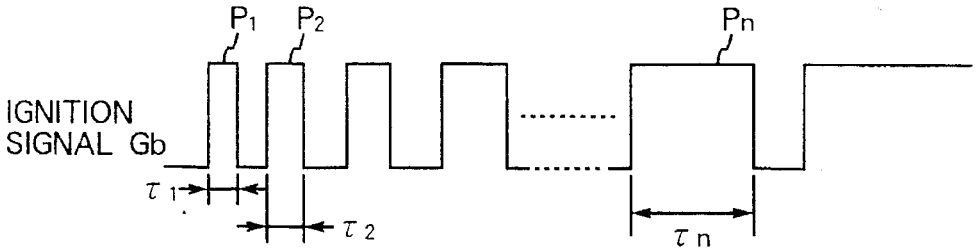
FIG. 5 is a waveform diagram showing the enlarged rising portion of an ignition signal for explaining operation of the second embodiment 2 of the present invention.

FIG. 5 is a waveform diagram showing the enlarged rising portion of the ignition signal Gb for explaining operation of the second embodiment of the present invention. In this case, it is assumed that the oscillation pulses P1–Pn at the rising of the ignition signal Gb have the gradually increasing oscillation pulse widths τ1–τn and the oscillation frequency thereof is gradually decreased.

Next, operation of the second embodiment of the present invention shown in FIG. 4 will be described with reference to FIG. 5.

Likewise the above-mentioned, the CPU 21B in the control circuit 2B outputs the ignition signal Gb for determining the supply and shut-off of a primary current i1 in accordance with an operating state signals D and the power transistor 14 in an ignition power unit 1A starts to supply the primary current il in response to the ignition signal Gb.

At the time, the oscillation circuit 23 and PWM circuit 24 in the CPU 21B cause the ignition sinal Gb to oscillate at a high frequency for a predetermined period as well as gradually increase the pulse widths τ1–τn of the high frequency oscillation pulses P1–Pn as shown in FIG. 5 at a time when the ignition signal Gb rises.

With this operation, a collector potential Vc drops not steeply but stepwise in synchronism with the initial oscillation pulses P1–Pn of the ignition signal Gb likewise the aforesaid case so that only a stepwise low-tension noise signal is superposed with a secondary voltage V2.

Further, since the waveform of the ignition signal Gb gradually approaches a conventional rectangular waveform by gradually increasing the oscillation pulse widths τ1–τn of the ignition signal Gb, the gradual property of the rising ignition signal is further improved so that a noise signal to be superposed with the secondary voltage V2 can be more securely restrained.

What is claimed:

1. An ignition apparatus for an internal combustion engine comprising:

an ignition power unit having an ignition coil and a power transistor for supplying and shutting off a primary current to the ignition coil; and a control circuit for determining an ignition timing of said internal combustion engine and a period for supply of said primary current in accordance with driving conditions of said internal combustion engine so that it generates an ignition signal in the form of a pulse to said power transistor, said primary current being supplied and shut off by said power transistor in accordance with said ignition signal so that a high-tension secondary voltage is produced from said ignition coil;

said control circuit comprising an oscillation circuit which starts to operate from a point when said ignition signal rises, and continues to operate for a predetermined period shorter than a pulse width of said ignition signal, the waveform of said ignition signal thereby being made to rise substantially gradually.

2. An ignition apparatus for an internal combustion engine according to claim 1, wherein said control circuit further comprises a PWM circuit which operates in synchronism with said oscillation circuit to gradually increase the oscillation pulse widths during rising of said ignition signal.

* * * * *